US010553928B2

(12) United States Patent
Kao

(10) Patent No.: US 10,553,928 B2
(45) Date of Patent: Feb. 4, 2020

(54) ANTENNA ROTATING HEAD WITH A DOUBLE GROOVES STRUCTURE

(71) Applicant: PHIHONG TECHNOLOGY CO., LTD., Taoyuan (TW)

(72) Inventor: Ming-Shen Kao, New Taipei (TW)

(73) Assignee: PHIHONG TECHNOLOGY CO., LTD., Taoyuan (TW)

( * ) Notice: Subject to any disclaimer, the term of this patent is extended or adjusted under 35 U.S.C. 154(b) by 210 days.

(21) Appl. No.: 15/693,504

(22) Filed: Sep. 1, 2017

(65) Prior Publication Data

US 2019/0074573 A1 Mar. 7, 2019

(51) Int. Cl.
*H01Q 3/00* (2006.01)
*H01Q 1/12* (2006.01)

(52) U.S. Cl.
CPC ..... *H01Q 1/125* (2013.01); *H01Q 1/1235* (2013.01)

(58) Field of Classification Search
CPC ..... H01Q 3/00; H01Q 1/05
USPC ..... 343/763
See application file for complete search history.

(56) References Cited

U.S. PATENT DOCUMENTS 4,647,936 A * 3/1987 Taikawa ..... H01Q 1/084 343/702
5,343,213 A * 8/1994 Kottke ..... H01Q 1/088 343/702
5,422,651 A * 6/1995 Chang ..... H01Q 1/084 343/702
6,002,378 A * 12/1999 Harada ..... H01Q 21/10 343/903
6,268,830 B1 * 7/2001 Nakagawa ..... H01Q 1/244 343/702
6,937,191 B2 * 8/2005 Puente Baliarda .... H01Q 1/246 343/700 MS

* cited by examiner

*Primary Examiner* — Huedung X Mancuso
(74) *Attorney, Agent, or Firm* — Chih Feng Yeh; Huntington IP Consulting Co., Ltd.

(57) ABSTRACT

The present invention provides an antenna rotating head with a double grooves structure. The antenna includes an antenna body and an antenna rotating head. The antenna body receives signals. The antenna rotating head coupled to the antenna body. The antenna rotating head comprises a rotor, a housing and a base. The rotor has at least one groove, wherein the rotor is free to rotate. The housing coupled to the rotor to prevent the rotor from falling off. The base coupled to the housing to fix the housing. The rotor further comprises a rotor head, a rotor disc and a rotor body. The rotor head fixes the antenna body. The rotor disc coupled to the rotor head to abut against the housing. The rotor body coupled to the rotor disc, wherein the at least one groove is located on the rotor body.

17 Claims, 6 Drawing Sheets

ANTENNA ROTATING HEAD WITH A DOUBLE GROOVES STRUCTURE

BACKGROUND OF THE INVENTION

Field of the Invention

The present invention generally relates to an antenna rotating head, and more particularly, to an antenna rotating head with a double grooves structure.

Description of Related Art

The use of the antenna has a long history. An antenna is an electrical device which converts radio-frequency energy (or radio waves) into alternating current, and vice versa. Radio-frequency energy is electromagnetic wave which carries signals through the space at the speed of light with almost no transmission loss. An antenna is usually used with a radio transmitter or radio receiver. In reception, an antenna intercepts some of the power of a radio-frequency energy in order to produce a tiny voltage at its terminals, that is applied to a receiver to be amplified. In transmission, a radio transmitter supplies an alternating current at radio frequency to the antenna's terminals, and the antenna radiates the energy from the current as radio-frequency energy.

Antennas are essential components of all equipment that uses radio. They are used to convey signals in systems such as two-way radio, radio broadcasting, broadcast television, radar, communications receivers, cell phones, and satellite communications, as well as other devices such as wireless microphones, garage door openers, Bluetooth-enabled devices, baby monitors, wireless computer networks and so on.

However, the user often needs to pull the antenna out or push the antenna back in the telescopic antennas. The user also often needs to rotate the antenna in order to adjust the angle of the antenna to improve the quality of the reception. Therefore, the general antenna is easy to damage at the antenna rotating head. The general antenna rotating head has structural defects.

The general antenna has an antenna body and an antenna rotating head. But, the traditional antenna rotating head has only one necking in the traditional housing. In the traditional antenna rotating head, the rotor can only rely on the necking of the housing to clamp. When the antenna rotating head to bear more power will be pulled out. In another example, when the antenna body is often shaken, the necking in the housing is easily enlarged. The rotor will be easily loosened from the enlarged necking. For the reasons, the general antenna rotating head is liable to be damaged.

What is required is an improved structure for the antenna rotating head.

SUMMARY OF THE INVENTION

In order to solve the problem of the conventional arts, the present invention provides an antenna rotating head with a double grooves structure. Its various parts are more closely connected and the structure is more stable. Therefore, the present invention can avoid the damage of the antenna rotating head. An object of the present invention is to provide an antenna rotating head with a double grooves structure. The antenna includes an antenna body and an antenna rotating head. The antenna body receives signals. The antenna rotating head coupled to the antenna body. The antenna rotating head comprises a rotor, a housing and a base. The rotor has at least one groove, wherein the rotor is free to rotate. The housing coupled to the rotor to prevent the rotor from falling off. The base coupled to the housing to fix the housing.

According to the embodiment of the present invention, the rotor further comprises a rotor head, a rotor disc and a rotor body. The rotor head fixes the antenna body. The rotor disc coupled to the rotor head to abut against the housing. The rotor body coupled to the rotor disc, wherein the at least one groove is located on the rotor body.

According to the embodiment of the present invention, the rotor body further comprises a rotor body disc. The rotor body disc forms a rotor body groove between the rotor disc and the rotor body disc. The housing further comprises a necking. The necking allows the rotor head to pass through and sticks the rotor disc. The housing further comprises a first housing groove. The first housing groove engages the base. The housing further comprises a second housing groove. The second housing groove engages the rotor body groove. The first housing groove further comprises a protrusion. The first housing groove engages the base through the protrusion. The base further comprises a base groove. The base groove engages the first housing groove. The base groove further comprises a base hole. The base hole fixes the protrusion. The antenna rotating head further comprises a bottom cover. The bottom cover coupled to the base to connect to other external devices. The bottom cover further comprises a screw hole. The bottom cover connects to other external devices through the screw hole.

According to the embodiment of the present invention, the necking is located at one end of the housing. The first housing groove is located at the other end of the necking. The second housing groove is close to the necking. The base groove is in the middle of the base.

BRIEF DESCRIPTION OF THE DRAWINGS

The components, characteristics and advantages of the present invention may be understood by the detailed description of the preferred embodiments outlined in the specification and the drawings attached.

DETAILED DESCRIPTION

Some preferred embodiments of the present invention will now be described in greater detail. However, it should be recognized that the preferred embodiments of the present invention are provided for illustration rather than limiting the present invention. In addition, the present invention can be practiced in a wide range of other embodiments besides those explicitly described, and the scope of the present invention is not expressly limited except as specified in the accompanying claims. The layout of components may be more complicated in practice.

Figure 1:
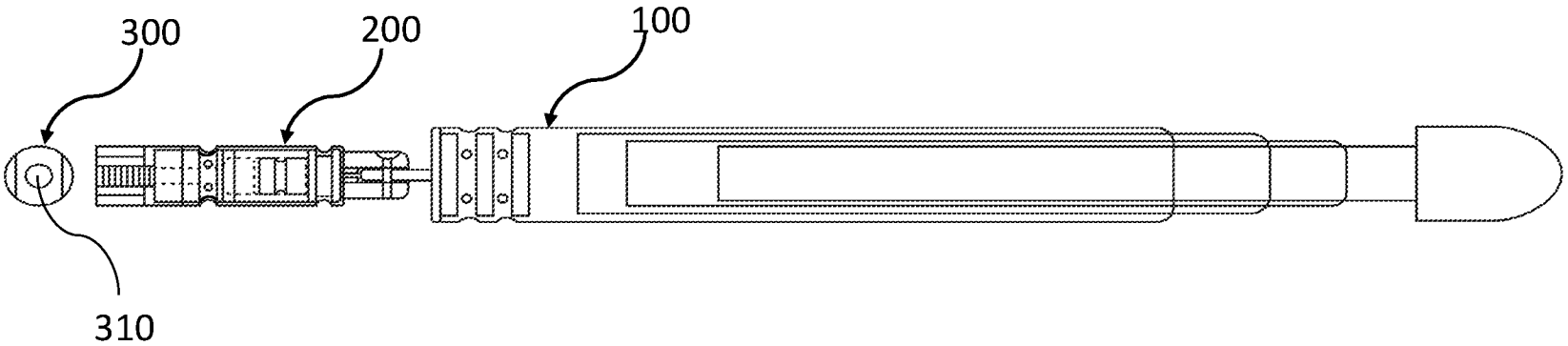
FIG. 1 illustrates the overall composition of the antenna of the present invention.
Figure 2:
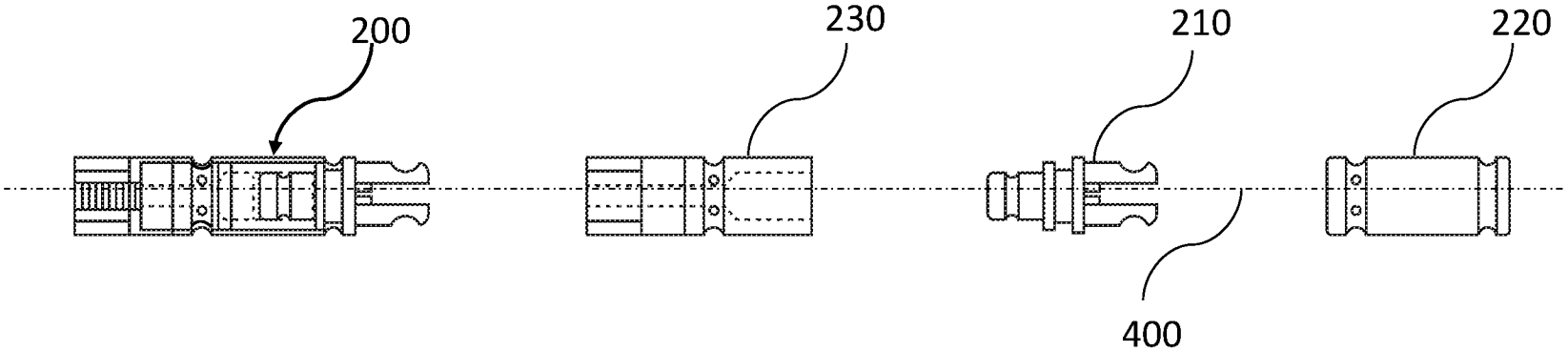
FIG. 2 illustrates an exploded view of the antenna rotating head of the present invention.

Please refer to FIG. 1, it illustrates the overall composition of the antenna of the present invention. It includes antenna body 100 and the antenna rotating head 200 which is engaged with the antenna body 100. Please refer to FIG. 2, it illustrates an exploded view of the antenna rotating head 200 of the present invention. The structure of the antenna rotating head 200 is divided into a housing 220, a rotor 210 and a base 230 along the auxiliary line 400. The antenna rotating head 200 with a double grooves structure. The antenna includes an antenna body 100 and an antenna rotating head 200. The antenna body 100 receives signals. The antenna rotating head 200 coupled to the antenna body 100. The antenna rotating head 200 comprises a rotor 210, a housing 220 and a base 230. The rotor 210 has at least one groove 212, wherein the rotor 210 is free to rotate. The housing 220 coupled to the rotor 210 to prevent the rotor 210 from falling off. The base 230 coupled to the housing 220 to fix the housing 220. The main signal received by the antenna body 100 is a wireless signal. The wireless signals include radio waves, microwaves, etc., but are not limited thereto. The reception of wireless signals is often blocked by obstacles. Even at the same position, the different receiving angles result in different intensity signals. Since the antenna rotating head 200 can be adjusted to receive signal from different orientations, it is often turned by the user. Therefore, the antenna rotating head 200 plays an important role. The basic structure of the antenna rotating head 200 of the present invention is composed of a housing 220, a rotor 210 and a base 230. The basic structure allows the antenna rotating head 200 to rotate freely and have a solid structure. In addition, the structure of the rotor 210 having at least one groove 212 is prevented from being pulled out after rotation. The rotor 210 of the present invention has at least one groove 212 which allows the structure to be more stable.

Figure 4A:
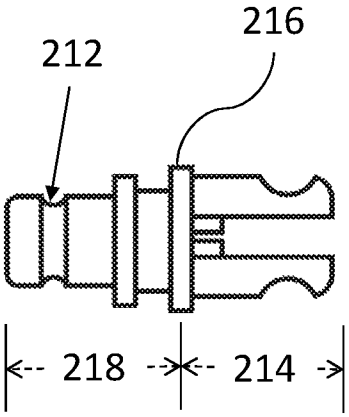
FIG. 4A illustrates the structure of the rotor of the present invention.
Figure 4B:
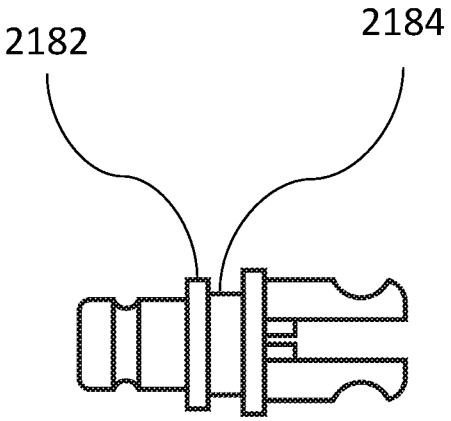
FIG. 4B illustrates the structure of the rotor of the present invention.

Please refer to FIG. 4A and FIG. 4B, they illustrate the structure of the rotor 210 of the present invention. In one embodiment, the rotor 210 further comprises a rotor head 214, a rotor disc 216 and a rotor body 218. The rotor head 214 fixes the antenna body 100. The rotor disc 216 coupled to the rotor head 214 to abut against the housing 220. The rotor body 218 coupled to the rotor disc 216, wherein the at least one groove 212 is located on the rotor body 218. The rotor body 218 further comprises a rotor body disc 2182. The rotor body disc 2182 forms a rotor body groove 2184 between the rotor disc 216 and the rotor body disc 2182. The housing 220 further comprises a necking 222. The necking 222 allows the rotor head 214 to pass through and sticks the rotor disc 216. The rotor disc 216 divides the rotor 210 into the rotor head 214 and the rotor body 218. The rotor disc 216 can be stuck by the necking 222 to allow the antenna body 100 to be firmly fixed to the antenna rotating head 200. In addition, the rotor disc 216 can be freely rotated inside the housing 220 to allow the antenna body 100 to adjust its angle. There are holes in the rotor head 214. It passes through the holes and the antenna body 100 by screws. The antenna body 100 is connected to the rotor head 214 where it can be bent. The antenna body 100 can be rotated 360 degrees and can be bent 180 degrees.

Figure 3:
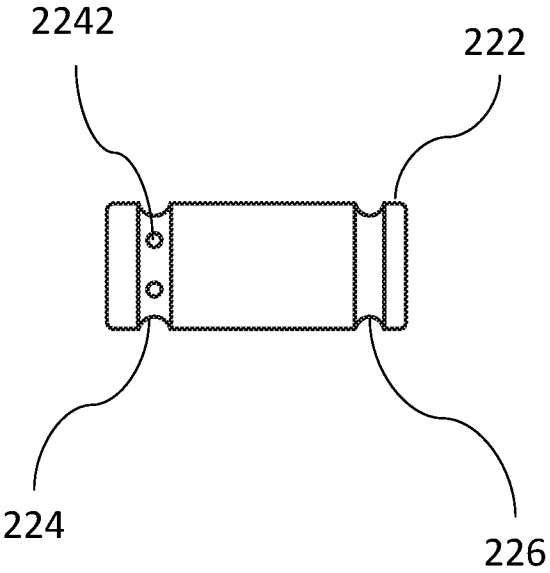
FIG. 3 illustrates the structure of the housing of the present invention.

Please refer to FIG. 3, it illustrates the structure of the housing 220 of the present invention. In one another embodiment, the housing 220 further comprises a first housing groove 224. The first housing groove 224 engages the base 230. The housing 220 further comprises a second housing groove 226. The second housing groove 226 engages the rotor body groove 2184. Because the first housing groove 224 engages the base 230 and the second housing groove 226 engages the rotor body groove 2184 to form a double grooves structure, the double grooves structure brings many benefits to the antenna rotating head 200. For example, the double grooves structure of the rotor 210 offers more fixations to the antenna rotating head 200. In another case, due to the double grooves structure, antenna rotating head 200 is unlikely to separate from the antenna body 100 even the antenna body 100 is shaken dramatically. Furthermore, because there is a rotor body groove 2184, when the antenna body 100 is impacted by external forces, the external forces can be evenly dispersed.

Figure 5:
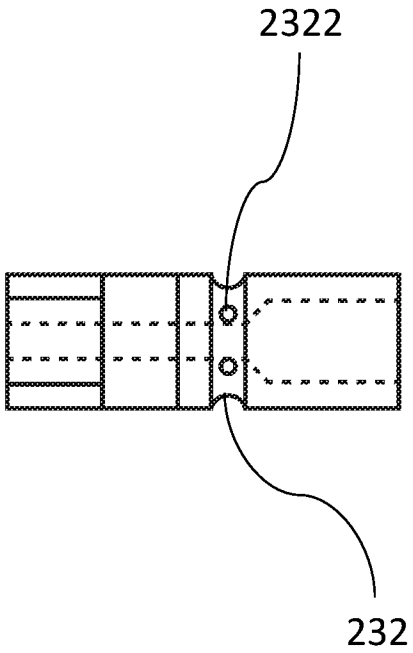
FIG. 5 illustrates the structure of the base of the present invention.

Please refer to FIG. 5, it illustrates the structure of the base 230 of the present invention. In another embodiment, the first housing groove 224 further comprises a protrusion 2242. The first housing groove 224 engages the base 230 through the protrusion 2242. The base 230 further comprises a base groove 232. The base groove 232 engages the first housing groove 224. The base groove 232 further comprises a base hole 2322. The base hole 2322 fixes the protrusion 2242. The protrusion 2242 can be fixed with the base hole 2322 to fix the direction so that the housing 220 and the base 230 can not rotate with each other. Because the housing 220 will not be rotated, so the rotor 210 can fix rotation angle through the friction between the housing 220 and the rotor 210.

In another embodiment, the antenna rotating head 200 further comprises a bottom cover 300. The bottom cover 300 coupled to the base 230 to connect to other external devices. The bottom cover 300 further comprises a screw hole 310. The bottom cover 300 connects to other external devices through the screw hole 310. The external devices include: radio, analog TV, set-top box, mobile phone, car, etc., but not limited to this.

In one embodiment, the necking 222 is located at one end of the housing 220. The first housing groove 224 is located at the other end of the necking 222. The second housing groove 226 is close to the necking 222. The base groove 232 is in the middle of the base 230. The location of each component can be adjusted according to the needs of the user. However, the position of each component allows the antenna to maximize the stability and functionality of the structure. For example, the first housing groove 224 is located at the other end of the necking 222, this location allows the rotor 210 to have enough space to form the grooves 212.

Various terms used in this disclosure should be construed broadly. For example, if an element "A" is to be coupled to or with element "B," element A may be directly coupled to element B or be indirectly coupled through, for example, element C. When the specification states that a component, feature, structure, process, or characteristic A "causes" a component, feature, structure, process, or characteristic B, it means that "A" is at least a partial cause of "B" but that there may also be at least one other component, feature, structure, process, or characteristic that assists in causing "B." If the specification indicates that a component, feature, structure, process, or characteristic "may", "might", or "could" be included, that particular component, feature, structure, process, or characteristic is not required to be included. If the specification refers to "a" or "an" element, this does not mean there is only one of the described elements.

The foregoing descriptions are preferred embodiments of the present invention. As is understood by a person skilled in the art, the aforementioned preferred embodiments of the present invention are illustrative of the present invention rather than limiting the present invention. The present invention is intended to cover various modifications and similar arrangements included within the spirit and scope of the appended claims, the scope of which should be accorded the broadest interpretation so as to encompass all such modifications and similar structures.

I claim:

1. An antenna comprising:

an antenna body for receiving signals;

an antenna rotating head, coupled to said antenna body, comprising:

a rotor having at least one groove, wherein said rotor is free to rotate;

a housing coupled to said rotor to receive said rotor; and a base coupled to said housing to fix said housing;

wherein said rotor comprises: a rotor head, fixing said antenna body; a rotor disc, coupled to said rotor head, abutting against said housing; and a rotor body, coupled to said rotor disc, said at least one groove being located on said rotor body, said rotor body comprising a rotor body disc, forming a rotor body groove between said rotor disc and said rotor body disc, said housing comprising a first housing groove, engaging said rotor body groove to prevent said rotor from falling off said housing.

2. The antenna of claim 1, said housing further comprising:

a necking, allowing said rotor head to pass through and sticking said rotor disc.

3. The antenna of claim 2, said housing further comprising:

a second housing groove, engaging said base.

4. The antenna of claim 1, said second housing groove further comprising:

a protrusion, said second housing groove engaging said base through said protrusion.

5. The antenna of claim 4, said base further comprising:

a base groove, engaging said second housing groove.

6. The antenna of claim 5, said base groove further comprising:

a base hole, fixing said protrusion.

7. The antenna of claim 6, said antenna rotating head further comprising:

a bottom cover, coupled to said base, connecting to other external devices.

8. The antenna of claim 7, said bottom cover further comprising:

a screw hole, said bottom cover connecting to other external devices through said screw hole.

9. The antenna of claim 8, said necking being located at one end of said housing.

10. The antenna of claim 9, said second housing groove being located at the other end of said necking.

11. The antenna of claim 10, said first housing groove being close to said necking.

12. The antenna of claim 11, said base groove being in the middle of said base.

13. An antenna comprising:

an antenna body for receiving signals;

an antenna rotating head, coupled to said antenna body, comprising:

a rotor having at least one groove, wherein said rotor is free to rotate;

a housing coupled to said rotor to receive said rotor; and a base coupled to said housing to fix said housing;

wherein said rotor comprises: a rotor head, fixing said antenna body; a rotor disc, coupled to said rotor head, abutting against said housing; and a rotor body, coupled to said rotor disc, said at least one groove being located on said rotor body;

wherein said housing comprises: a necking, allowing said rotor head to pass through and sticking said rotor disc; a first housing groove, engaging said base;

wherein said necking is located at one end of said housing;

wherein said first housing groove is located at the other end of said necking, said rotor body comprising a rotor body disc, forming a rotor body groove between said rotor disc and said rotor body disc, wherein said housing further comprises a second housing groove, engaging said rotor body groove to prevent said rotor from falling off said housing.

14. The antenna of claim 13, wherein said second housing groove is close to said necking.

15. The antenna of claim 14, wherein said base further comprises: a base groove, engaging said first housing groove; wherein said base groove is in the middle of said base.

16. The antenna of claim 15, wherein said first housing groove further comprises: a protrusion, said first housing groove engaging said base through said protrusion; wherein said base groove further comprises: a base hole, fixing said protrusion.

17. The antenna of claim 16, wherein said antenna rotating head further comprises: a bottom cover, coupled to said base, connecting to other external devices; wherein said bottom cover further comprises: a screw hole, said bottom cover connecting to other external devices through said screw hole.

* * * * *